US005915435A

United States Patent [19]

Wilen et al.

[11] Patent Number: 5,915,435

[45] Date of Patent: Jun. 29, 1999

[54] EXPANDABLE DUSTER ASSEMBLY

[75] Inventors: Joseph M. Wilen, Atlanta; James F. Sloan, Newnan, both of Ga.

[73] Assignee: Wilen Acquisition Corporation, Wrens, Ga.

[21] Appl. No.: 08/728,817

[22] Filed: Oct. 7, 1996

[51] Int. Cl.[6] ..... A46B 15/00; A46B 17/04

[52] U.S. Cl. ..... 15/184; 15/144.4; 15/169; 15/207.2; 206/362.3

[58] Field of Search ..... 15/1.52, 144.3, 15/144.4, 165, 168–170, 184, 207.2, 234; 206/15.2, 15.3, 362.3

[56] References Cited

U.S. PATENT DOCUMENTS

| | | | |
|---|---|---|---|
| 893,271 | 7/1908 | Snevely | 15/184 X |
| 1,322,641 | 11/1919 | Stanley | 15/169 |
| 1,355,026 | 10/1920 | Austin | 15/169 X |
| 1,538,220 | 5/1925 | Shultz | 15/169 X |
| 2,290,534 | 7/1942 | Cave | 15/184 X |
| 2,485,822 | 10/1949 | Goldrich | 15/184 X |
| 2,984,852 | 5/1961 | George | 15/144.4 |
| 3,829,923 | 8/1974 | Shaw et al. | 15/207.2 |
| 4,373,224 | 2/1983 | Bandai et al. | 15/1.52 |
| 4,393,535 | 7/1983 | Kunz | 15/169 |
| 4,524,484 | 6/1985 | Graham | 15/144.4 X |

FOREIGN PATENT DOCUMENTS

| | | | |
|---|---|---|---|
| 603684 | 4/1926 | France | 15/184 |
| 1140900 | 12/1962 | Germany | 15/207.2 |
| 273070 | 3/1930 | Italy | 15/169 |
| 303820 | 12/1932 | Italy | 15/234 |
| 91673 | 3/1938 | Sweden | 15/184 |
| 185107 | 5/1937 | Switzerland | 15/169 |
| 405432 | 2/1934 | United Kingdom | 15/184 |
| 498910 | 4/1937 | United Kingdom | 15/169 |
| 838141 | 6/1960 | United Kingdom | 15/207.2 |

OTHER PUBLICATIONS

Wilen Companies Catalog Entitled "Clearly Focused on Cleaning", p. 44, Oct. 1995.

*Primary Examiner*—Mark Spisich
*Attorney, Agent, or Firm*—Womble Carlyle Sandridge & Rice, PLLC

[57] ABSTRACT

An improved dusting device includes a handle, a bristle head, bristles extending transversely from the bristle head, and a cover for radially collapsing the bristles during shipping and retail display. The bristle head receives and supports a plurality of bristles, wherein each bristle includes a first end attached to the handle first end and a terminal second end for engaging particles. Each bristle is capable of retaining its original shape after prolonged deformation, as they are comprised of elongated strands of polyvinyl chloride. The invention includes a bristle cover adapted for use with the dust mop during storage, shipping and retail display. After assembly of the mop, the cover slides over the bristle head and bristles, and compresses the bristles into a compact formation, which reduces the effective shipping and storage volume of the device, and allows a greater number of dusting devices to be stored in a standard sized shipping box than prior art dusting devices. Transversely extending bristles engage an inner surface of the cover to releasably retain the cover over the bristles. The improved dusting device also includes a centering portion on the handle for aligning the cover with the bristles.

19 Claims, 4 Drawing Sheets

EXPANDABLE DUSTER ASSEMBLY

FIELD OF THE INVENTION

The present invention relates to the construction, packaging, and display of an improved cleaning implement. More particularly, the present invention relates to the construction and packaging of an improved overhead cobweb duster.

BACKGROUND OF THE INVENTION

Dust mops (otherwise known as "cobweb dusters") are well known in the art and may include any number of materials in their construction. For example, before the development of plastics, dust mop components generally included a wooden or metal elongate handle with a head portion constructed of some type of fabric, such as cotton. Generally, the head portion of the mop removes unwanted debris from various areas which are not readily accessible by other means. Examples of inaccessible areas may include overhead fan blades, air vents, or ceiling corners.

In many instances, polymer fibers now replace fabric materials for use in dust mob heads. However, those prior art dust mops utilize polyethylene or polystyrene bristles fastened to a bristle head for use in entangling dust particles. Several disadvantages are associated with the use of such polymers as bristles in a dust mop head. Typically, the polyethylene or polystyrene fibers used in prior art dusters do not have an acceptable shape memory to allow for prolonged mop head deformation during packaging and shipping. For example, if a prior art dust mop is placed on its side between uses, the polystyrene or polyethylene fibers in the dust mop head become permanently deformed, which decreases the effectiveness and aesthetic appearance of the mop. Additionally, if a prior art dust mop head is compressed in any way during shipping, then permanent deformation occurs. Permanent deformation of a mop head is undesirable since it decreases the particle entanglement effectiveness of the fibers. Thus, during distribution storage and shipping processes, such prior art dust mops must be packed with the mop head in a completely expanded configuration, greatly increasing the volume consumed by a single mop and reducing the shipping volume efficiency associated with the prior art dust mop. Furthermore, prior art dust mops using the above-referenced compliant polyethylene or polystyrene bristle material have to be adequately protected during shipping by various types of materials such as "bubble paper" to minimize deformation during shipping and storage such package material and space requirements increases the production cost.

With the forgoing disadvantages in mind, it is an object of the present invention to provide a cleaning implement or dust mop which requires as little shipping volume and retail display area as possible. It is another object of the present invention to provide a dust mop which is displayed in a manner that is aesthetically pleasing to a consumer in a retail environment. Still another object of the present invention is to provide a dust mop which includes a means of compressing the mop head during shipping and retail storage to reduce the effective mop head volume. Yet another object of the present invention is to provide fibers that are durable and flexible, but have an excellent shape memory so that after a mop head compressing means is removed from the mop head, the mop head will return to its original expanded state with little or no permanent deformation.

SUMMARY OF THE INVENTION

Generally speaking, the present invention relates to an implement for removing undesirable particles from remote locations. The implement may include a handle connected to a bristle head and a plurality of bristles for engaging undesirable particles in various crevices.

More specifically, the present invention relates to a dusting device including a handle, a bristle head, bristles extending transversely from the bristle head, and a cover for collapsing the bristles during shipping, retail display and storage. The dusting device handle includes a longitudinal axis and first and second ends, and receives the bristle head at the first handle end. Each bristle is capable of retaining its original shape after prolonged deformation, as they are comprised of elongated strands of polyvinyl chloride. Polyvinyl chloride has a greater shape memory than previous materials used for dust mop strands such as polypropylene or polystyrene.

In a preferred embodiment, each bristle includes a base adjacent the bristle head, and each bristle base extends from the bristle head at an orientation which is approximately perpendicular to a tangent on a surface of the bristle head proximate the bristle base. However, the bristles may extend at any angle from a surface of the bristle head to effectuate the intended functions of the present invention. In the preferred embodiment of the present invention, at least some of the bristles are generally straight, however, the bristles may also have an arcuate shape, to the extent that such a shape facilitates the removal of dust or other particles. Furthermore, each bristle may include flagged ends for enhancing particle entanglement. For the purposes of this specification, flagging generally refers to the creation of fine filaments at a distal end of the bristles for the purpose of facilitating entanglement between the filament terminal end and particles to be removed by the dusting implement.

In a preferred embodiment, the bristle head may be generally cylindrical in shape, and may include an end surface having a portion which is generally perpendicular to the handle longitudinal axis, wherein bristles extend from the bristle head second end. In the preferred embodiment, however, the bristle head end surface is generally semi-spherical in shape. The bristle head may also include a plurality of bristle bores, wherein each bristle bore is adapted to receive a plurality of bristles.

Another important aspect of the present invention relates to a bristle cover adapted for use with the dust mop during storage, shipping and retail display. After assembly of the mop, the cover slides over the bristle head and bristles, radially collapsing the bristles into a compact formation, which reduces mop head volume, therefore allowing for a greater number of the inventive mops to be stored in a standard sized shipping box than expanded prior art dust mops. The bristle cover includes an outer wall, a first open end and an end wall on a second end of the cover. The cover end wall also includes an opening in a center portion thereof for accepting the dust mop handle therethrough wherein bristles extending transversely from the bristle head engage an inner surface of the wall to releasably retain the cover over the bristles. When the cover is completely enclosing the mop head, the bristles conform to a shape of the cover.

The bristle head also includes an annular shoulder proximate the first bristle head end for engaging the cover end wall on an interior portion of the cover when the cover completely encloses the bristles, thereby preventing further movement of the cover over the bristle head and off of the dust mop. Thus, while the product is on display, an eager consumer may not pull the cover completely over the bristle head and off of the mop, but may only move the cover toward the handle and off of the bristles. That arrangement does not allow the cover to be easily separated from the dust mop while the mop is on display, thus increasing the desirability of the entire product, including the mop and cover, to a distributor or retailer. Furthermore, a user may slide the cover onto the dust mop handle during use, and put the cover back on after use. In a preferred embodiment, the cover may comprise a generally cylindrical wall, a circular opening at the first cover end, and an annular end wall having a circular opening therein for allowing the mop handle to pass therethrough. The invention may also include means for releasably retaining the cover on the dust mop handle after the cover has been axially moved to expose the bristles. After use, a user may then release the cover and axially place it back over the bristle.

Another aspect of the present invention relates to a centering portion disposed on the handle for centering the cover on the bristles and bristle head immediately prior to enclosure of the bristles by the cover. More specifically, the centering portion is disposed between the first and second handle ends and proximate to the bristle head, wherein the centering portion includes a diameter larger than all other portions of the handle. The centering portion allows less clearance between the circular opening in the cover end wall and the centering portion than between the circular opening and all other portions of the handle. Even more specifically, a longitudinal length of the cover is configured to align the first open end of the cover adjacent the first bristle head end when the circular opening is axially aligned with the centering portion for facilitating placement of the cover over the bristles. The invention may also include means for releasably retaining the cover on the dust mop handle after the cover has been axially moved to expose the bristles. After use, a user may then release the cover and axially place it back over the bristles.

Another feature of the present invention includes a threaded receptacle disposed on the second end of the handle for releasably receiving a first threaded end of an elongated handle extension, which effectively lengthens the dust mop handle to allow the dust mop to remove particles from remote areas. For added convenience and effectiveness, the elongated handle extension may include first and second concentrically arranged telescoping members for changing the length of the elongated handle extension, so that a user of the mop may reach remote areas not otherwise accessible.

The present invention also relates to a filament or fiber for use as dust mop bristle, or the like. More specifically, a fiber in accordance with a preferred embodiment of the present invention may be formed from polyvinyl chloride (PVC), wherein the filament includes a first end adapted to be inserted to a support portion of a dusting implement, and a second end adapted to capture particles. Since PVC has a desirable shape memory, the PVC filament is adapted to retain its original shape after prolonged deformation. As discussed above, the inventive filament may also include a flagged portion on the second bristle end for capturing particles. Other materials (polymer or otherwise) which have a shape memory equivalent to PVC may also be used as bristles.

The invention also relates to a method for packaging a dust mop or the like for shipping, storage, and retail display. More specifically, the method may comprise the step of resiliently collapsing the bristles radially inward with a cover to reduce the overall volume of the mop. The method may comprise the step of axially adjusting the cover to collapse the bristles in preparation for packaging by radially compressing the bristles with the cover from a direction originating at the handle first end, and terminating axial movement of the cover by engaging the cover end wall against the bristle head first end. The method may also comprise the step of packing a dust mop having radially compressed bristles into a box for shipment. As discussed above, the method of enclosing and compressing the bristles allows the dust mop to retain the cover while on retail display, since a consumer must move the cover onto the handle, rather than completely off of the mop unit, to expose the bristles for product inspection.

The invention also relates to an inventive package in combination with an overhead duster including a box for enclosing a plurality of overhead dusters wherein the box includes sidewalls, top and bottom walls, an interior space within the walls and a box volume within an interior portion of the box. The combination also includes a plurality of overhead dusters, wherein each duster includes a handle portion attached to a bristle head and a plurality of bristles extending transversely from the head. Finally, the inventive combination includes a cover for radially compressing the bristles and for reducing an effective shipping volume of each bristle head to maximize the number of dust mop per unit box volume.

DETAILED DESCRIPTION OF THE DRAWINGS

DETAILED DESCRIPTION OF THE PREFERRED EMBODIMENT

Figure 2:
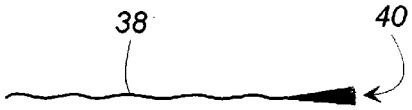
FIG. 2 is a perspective view of a single bristle used in the bristle head of the present invention.

A prospective view of an expandable duster assembly 2 according to the present invention is shown in partial section in FIG. 2. The expandable duster assembly includes several sections. Generally, a bristle head supports a plurality of bristles 38 within a bristle nest 18. Handle 5 supports bristle head 16. Handle 5 is comprised of first handle portion 12 which is threadingly received into section handle portion 14 via threaded extension 54 and internal threads 52. First handle portion 12 supports a telescoping handle extension assembly 6. Specifically, telescoping handle assembly 6 includes distal extension member 8 which telescopes over proximal extension member 10. Distal extension member 8 supports end plug 30. End plug 30 has a hanging aperture therethrough for allowing the expandable duster assembly to be hung from an appropriate hook.

The expandable duster assembly also includes a cover 4 which is adapted to protect and compress the bristles 38 for shipping, storage and retail displays. Cover 4 may take the form of virtually any shape, however, in a preferred embodiment it comprises a cylindrical wall having a first end which engages the bristle nest 18 and a second end which includes an end wall 22 attached thereto. The end wall 22 may be virtually any shape which facilitates packing and storage of the expandable duster assembly. In a preferred embodiment end wall 22 is substantially annular in shape and includes a circular hole and a center portion thereof for receiving handle 5 therethrough.

Figure 1:
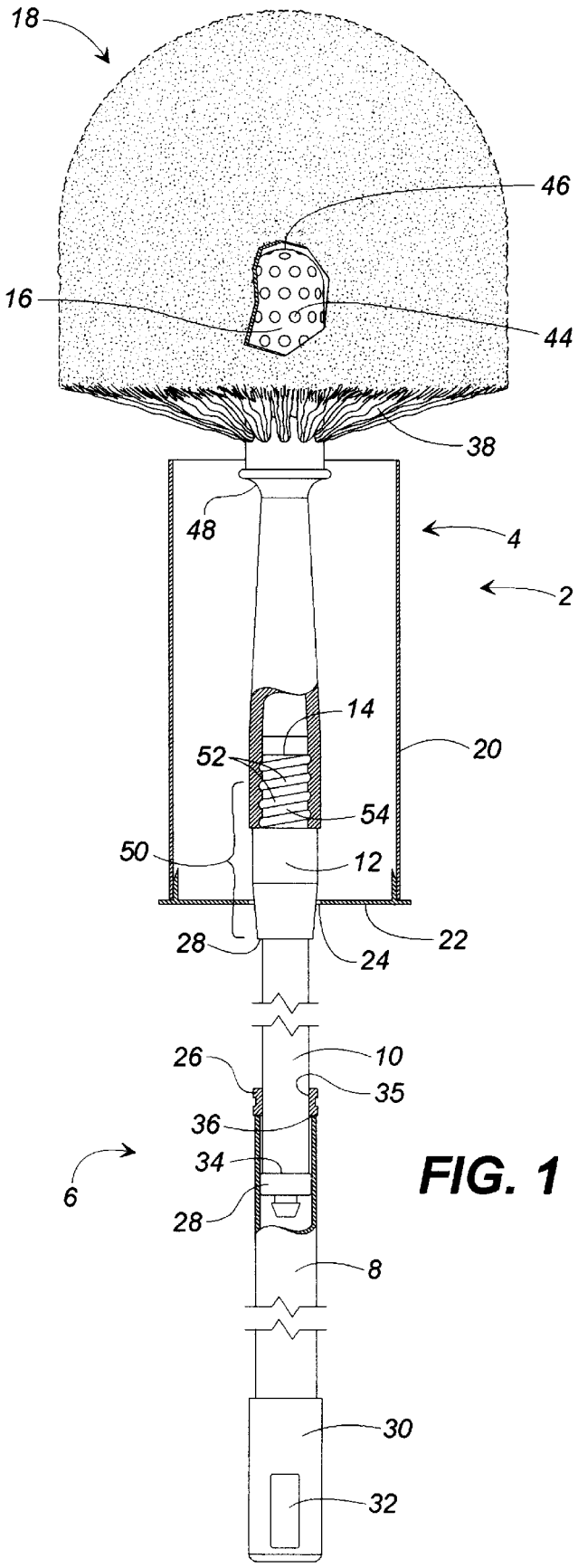
FIG. 1 is a perspective view of the present invention in partial cross-section illustrating the mop head, handle, handle extension and cover.

As illustrated in FIG. 1, the expandable duster assembly 2 includes a centering means 50 between first and second ends of handle 5. Centering means 50 actually consists of an enlarged diameter on the handle, approximately in the shape of a toroid, to center circular hole 24 against outer periphery of the centering device 50 and to center a forward portion of the cover 4 on the bristle nest 18, as is explained in greater detail below.

The telescoping extension members 8 and 10 include a stabilizing and motion limiting means for controlling the telescoping motion between the extension members. Specifically, distal extension member 8 includes an annular journal member 26 having a cylindrical surface 35 on an inside portion thereof for centering and contacting an outside surface of proximal extension member 10. Additionally, proximal extension member 10 includes a cylindrical guide member 28 fastened to an end portion thereof which includes an annular surface 34. Annular surface 34 engages annular surface 36 on annular journal member 26 to limit the maximum distance that extension members 8 and 10 travel with respect to one another.

FIG. 2 illustrates a single bristle 38 for use with the expandable duster assembly 2. A staple (not shown) generally holds a plurality of bristles 38 together. Bristle 38 has a crimp of approximately 7 waves per inch, where each wave approximates a full sinusoid. It has been found that such a crimp produces the rigidity needed to give fibers 38 the desired shape memory. Assembly machinery then inserts the group of bristles into bristle receiving bores on bristle head 16. Generally, an interference fit exist between groups of bristles inserted into bristle receiving bores 44 and the groups of bristles. Furthermore, bristle head 16 includes semi-spherical end portion 46 which has a plurality of bristle receiving bores thereon. The semi-spherical end portion 46 allows the bristle nest 38 to take a generally semi-spherical or elongated semi-spherical shape for maximum dusting performance.

Referring back to FIG. 2, each of fibers 38 is preferably formed from polyvinyl chloride ("PVC ") and has a flagged end portion 40. Applicant has found that PVC fibers work best in the present invention since PVC is relatively stiff, but still has an excellent shape memory. Most importantly, the PVC bristles 38 retain their shape after prolonged deformation. Therefore, cover 4 may radially collapse and deform each of the bristles 38 and when removed the bristles 38 return to their original shape. Additionally, each end 40 of bristles 38 may be "flagged". For the purposes of this specification, flagging refers to the slitting or splintering of the end of each fiber so as to create enhanced particle engaging qualities for each fiber. Since each fiber includes a flagged end portion 40 the entire nest 18 of the expandable duster assembly is very effective in removing dust particles from nooks, crannies, and remote areas.

Figure 3A:
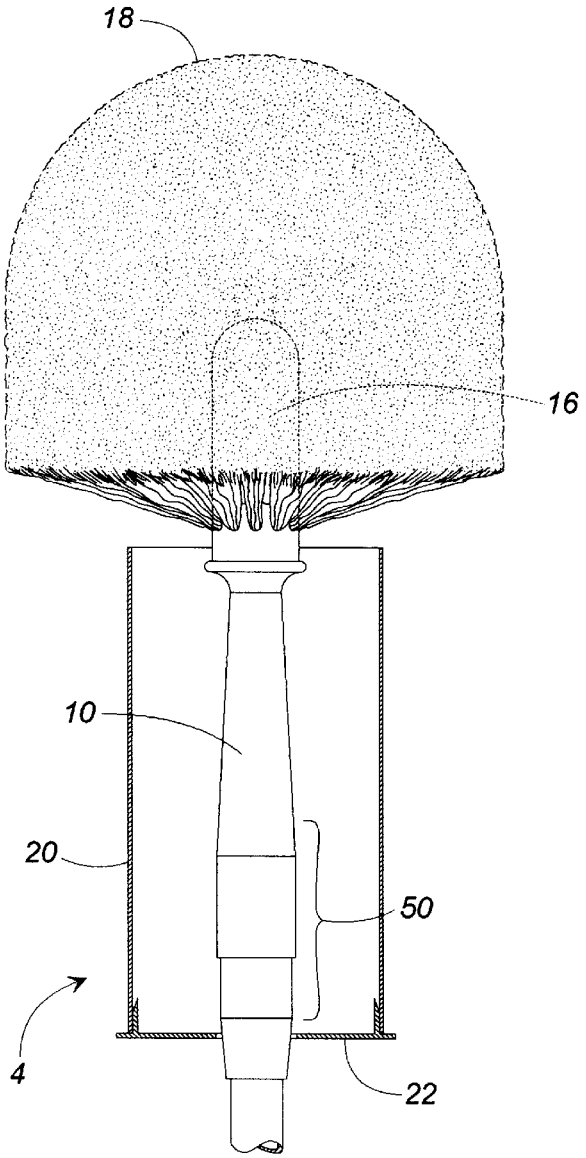
FIGS. 3A–3C illustrate sequential views of the cover axially traversing the dust mop handle to radially compress the mop fibers.
Figure 3B:
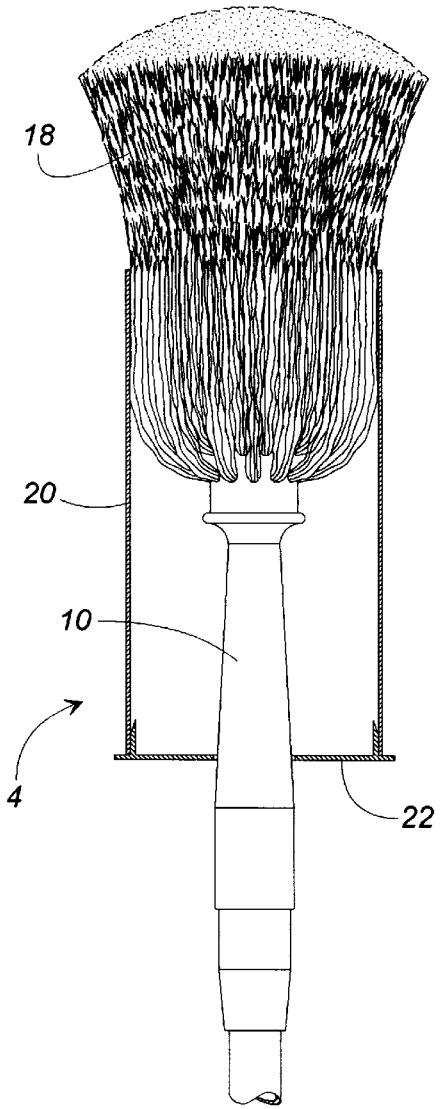
Figure 3C:
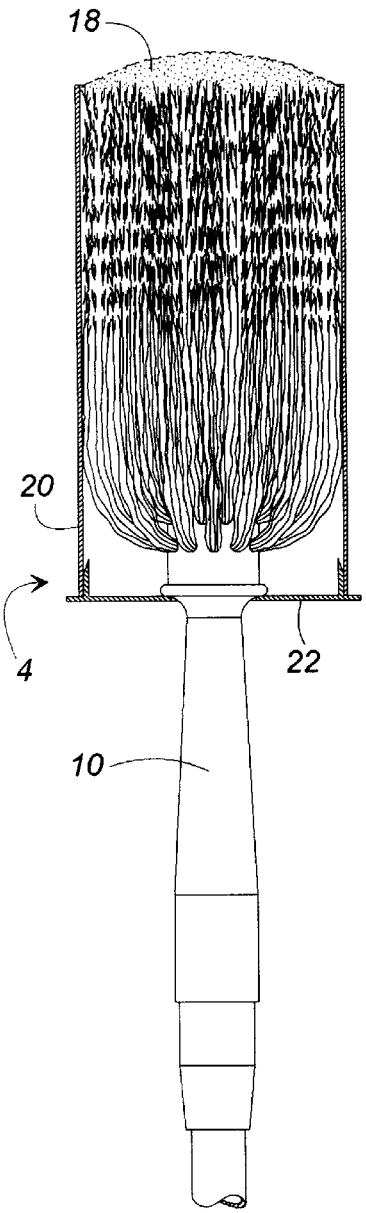

FIGS. 3A–3C illustrate in sequence axial translation of the cover 4 from centering portion 50 to annular ridge 48 of bristle head 16. FIG. 3 illustrates cover 4 in a position where end wall 22 is centered on centering portion 50 within handle 5 while cover 4 contacts a rear portion of bristle nest 18 on bristle head 16. FIG. 3B illustrates the cover 4 as it progresses past annular ridge 48 and begins to radially compress each of the fibers 38 within nest 18. Finally, FIG. 3C illustrates the cover 4 in a fully deployed position where end plate 22 contacts annular ridge 48 such that cover 4 completely encloses and has radially compressed each of fibers 38 within nest 18. As FIG. 3C illustrates, each of the fibers 38 is compressed radially inward and forwardly to conform with an inside shape of cover 4.

Figure 4:
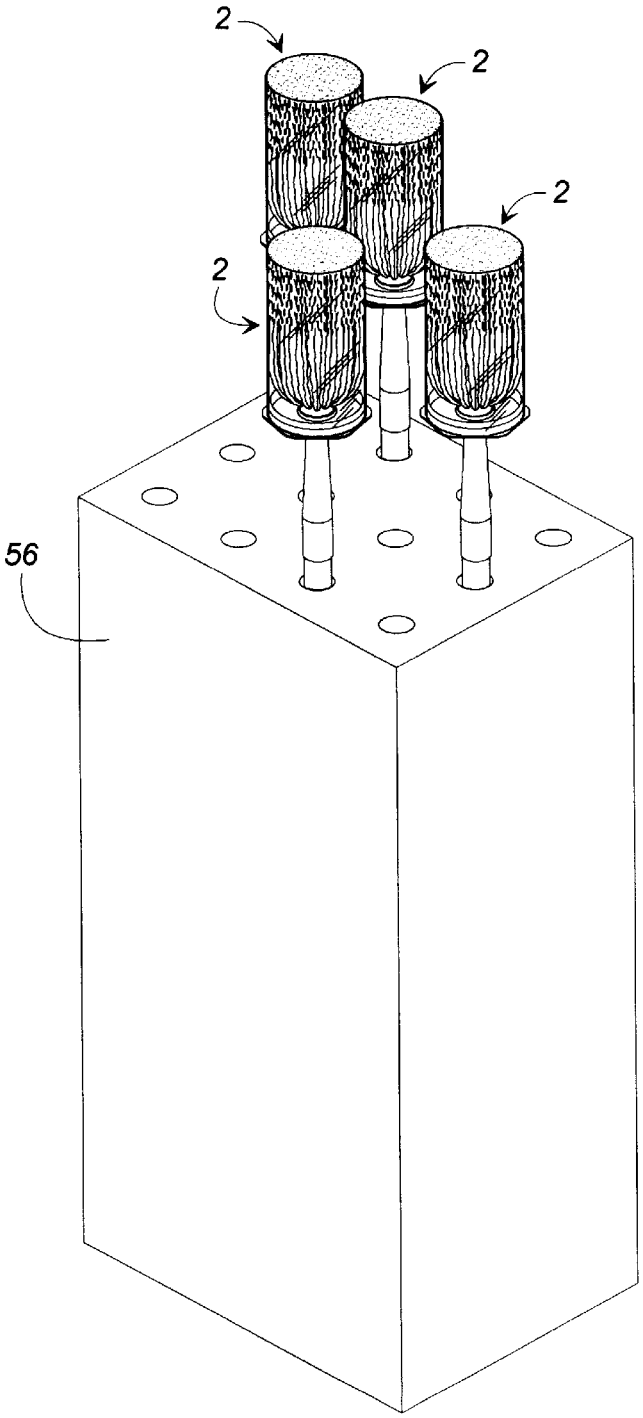
FIG. 4 illustrates a first display means for the present invention.
Figure 5:
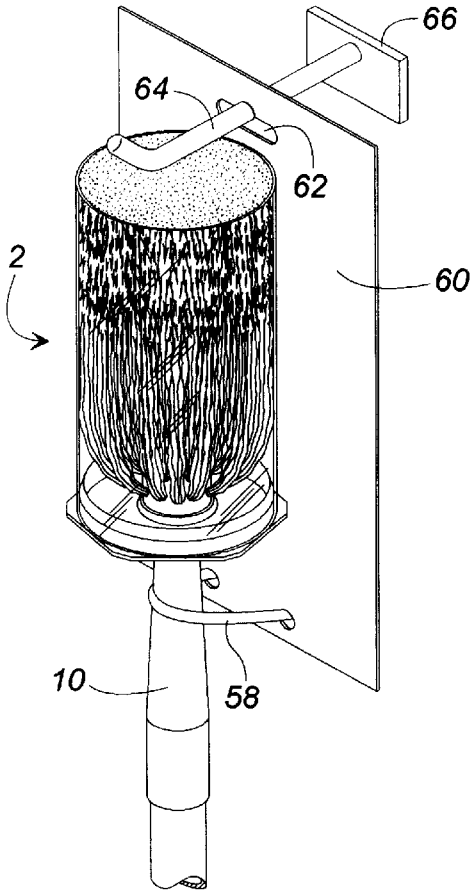
FIG. 5 illustrates a second display means for the present invention.

When cover 4 is removed, each of fibers 38 returns approximately to its original position and is ready for dusting. Additionally, the structure of cover 4 allows a consumer to inspect the bristles by moving the cover rearwardly away from the bristle nest 18 and down onto the handle without actually removing the cover from the expandable duster assembly 2. This feature prevents the cover from becoming separated from the duster assembly and makes the duster assembly very desirable to retailers who wish to display the expandable duster assembly 2. FIGS. 4 and 5 illustrates various ways in which the expandable duster assembly 2 may be displayed. For example, FIG. 4 illustrates a display box having a plurality of apertures on a top portion thereof. Each of the expandable duster assemblies may be inserted through the holes and displayed on the top portion of the box. Additionally, box 56 may completely house each of the expandable duster assemblies and include a panel on a front portion thereof which may be removed so that the products can be displayed. Additionally, the dust mops may be packed in boxes and shipped separately from their handles to increase shipping efficiency.

FIG. 5 shows an alternative display mechanism where the expandable duster assembly 2 is attached to a card board backing with a wire staple 58 so that the proximal extension 10 hangs down there from. The card board backing 60 includes an aperture 62 for receiving a hook 64. Hook 64 projects from a standard retail shelf 66.

The inventive bristle configuration and axial cover arrangement of the present invention allow for a great reduction in the shipping volume and display space required for the inventive duster assembly and prevent bristle intermingling between mops. For example, prior art dust mops, which were shipped with fully expanded bristle nests, required much more space within shipping boxes than dust mops configured in accordance with the present invention. Specifically, a typical shipping box having could only hold six (6) prior art dust mops without causing permanent deformation to the dust mops. However, that same may now hold at least thirty (30) dust mops which are configured in accordance with the present invention (having the bristle head compressed), where the prior art dust mops and dust mops according to the present invention have the same overall shipping length, but different bristle nest diameters.

Figure 6:
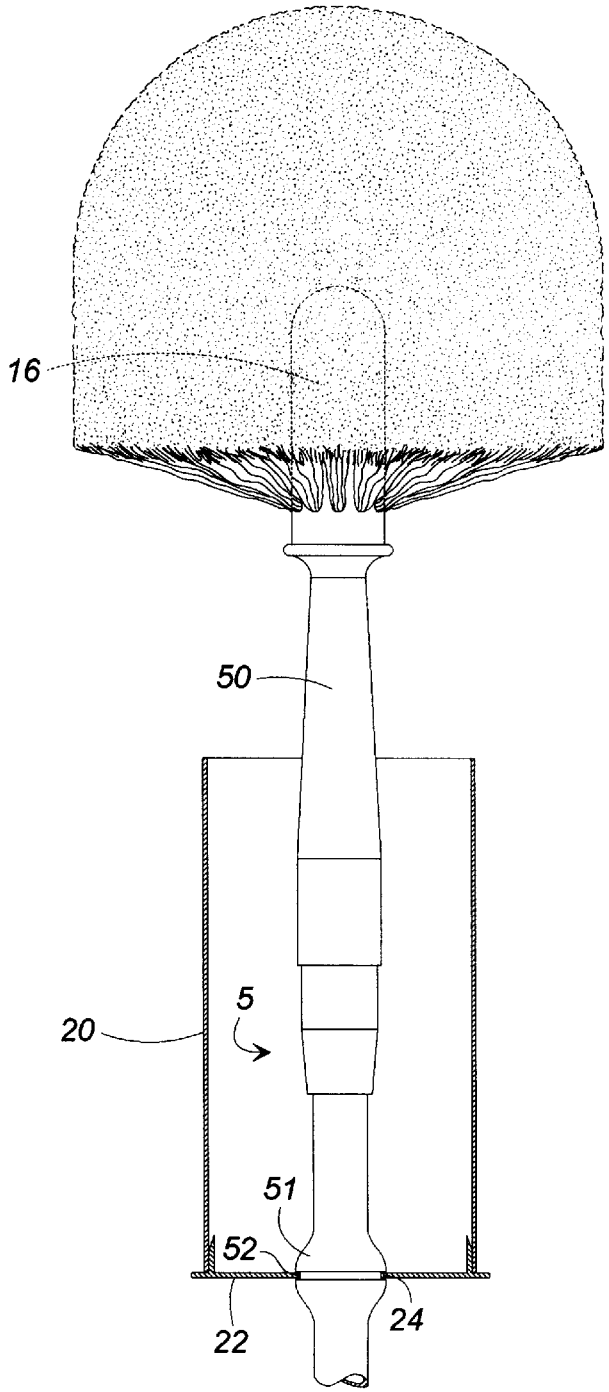
FIG. 6 is a perspective view of the present invention illustrating a cover retaining means.

FIG. 6 illustrates a means for releasably retaining cover 4 onto handle 5. In the embodiment shown in FIG. 6, handle 5 includes a handle retaining portion 51 disposed proximal to centering means 50 and opposite bristle head 16. The purpose of retaining means 51 is to releasably retain cover 4 into a retracted position away from bristle head 16 during use of the overhead duster assembly. The retaining means 51 may take a number of forms which accomplishes the function of releasably retaining cover 4. For example, releasably retaining means may be accomplished by an interference fit between circular opening 24 and a maximum outer diameter of retaining means 51. Alternatively, an annular recess 52 may interlock with circular opening 24 to releasably hold the cover 4 in position. When the user of the overhead expandable duster assembly is finished, the user may move cover 4 off of the retaining means 51 and place the cover over the bristle head 16 again.

The inventive method according to the present invention involves packing each of the duster assemblies into a box for shipping and retailed display. Steps of the inventive method may include resiliently collapsing the bristles radially within cover 4. Another step in the inventive method involves moving the cover collinearly on the handle to collapse the bristles in preparation for packaging, and terminating axial movement of the cover by engaging opening 24 against annular ring 48 on bristle head 16. The method may also include means for releasably retaining the cover on the handle after the handle has been actually moved from the handle to expose the bristles. For example, the circular opening may engage in retaining means 51 as was explained above with reference to FIG. 6.

Finally, the invention also relates to a package in combination with an overhead duster assembly. Specifically, the combination includes a box for enclosing a plurality of overhead duster when the box includes side walls and top and bottom walls, and the walls to find an interior space having a box volume within the box. Finally, the inventive combination includes a cover radially compressing the bristles and for reducing an effective shipping volume of each bristle head to maximum the number of dust mops per unit box volume. This combination is extremely important, since efficient shipping of the overhead dust mops reduces the ultimate product cost. Additionally, use of the cover in combination with a display means makes the overhead cobweb duster 2 much more appealing than prior art dust mops, the prior art dust mops do not include any means for effectively containing the bristles or any means for retaining a cover on the dust mop in a retail environment.

It would be obvious to those skilled in the art that many variations may be made in the above embodiments here chosen for the purpose for illustrating the present invention, and full may result may be had to the doctrine of equivalence without departing from the scope of the present invention is defined by the dependent claims. IN THE CLAIMS

What is claimed:

1. An overhead cobweb duster comprising:

a handle having a longitudinal axis and first and second ends;

a generally cylindrical bristle head disposed at said first handle end for receiving and supporting a plurality of bristles extending transversely from said bristle head, said bristle head including an end portion opposite said handle, wherein said end portion includes a substantially semi-spherical end surface, a plurality of bristle bores on a surface of said bristle head, wherein each said bristle bore is adapted to receive a plurality of bristles;

each said bristle including a first end attached to said handle first end, a second end, and a bristle base adjacent said first end, wherein each said bristle base extends from said bristle head at an orientation which is approximately perpendicular to a tangent on the surface of said bristle head proximate said bristle base, and wherein each said bristle retains its original shape after prolonged deformation;

a bristle cover adapted to radially compress said bristles, said cover including a generally cylindrical wall having a first open end a second end defined by a generally annular end wall, and a generally circular opening in a center portion of said end wall for accepting said handle therethrough, wherein said bristles engage an inner surface of said cylindrical wall to releasably retain said cover over said bristles, wherein said bristles conform to a shape of said cover;

an annular shoulder proximate said first handle end for engaging said cover end wall on an interior portion of said cover when said cover encloses said bristles for preventing further movement of said cover over said bristle head and off of said duster;

a centering portion disposed on said handle for centering said cover on over said bristles, wherein said centering portion is disposed between said first and second handle ends and proximate to said bristle head, said centering portion including a larger diameter larger than all other portions of said handle, wherein said centering portion allows less clearance between said circular opening and said centering portion than between said circular opening and all other portions of said handle; and wherein a longitudinal length of said cover is configured to align said first open end of said cover adjacent said first handle end when said circular opening is axially aligned with said centering portion for facilitating placement of said cover over said bristles.

2. An implement for removing undesirable particles from remote locations, said implement comprising:

a handle having a longitudinal axis and first and second ends;

a bristle head disposed at said first handle end for receiving and supporting a plurality of bristles, wherein said bristle head includes a first end attached to said first handle end, and said bristle head terminating at a second end;

a plurality of bristles having first and second ends and extending transversely from said bristle head, with at least some of said bristles being crimped between their ends to provide rigidity and shape memory to said bristles;

means for radially compressing said bristles for shipping, storage and retail display; and wherein said bristles retain their original shape after prolonged radial compression.

3. The implement of claim 2 wherein:

said bristles are comprised of elongated strands of polyvinyl chloride.

4. The implement of claim 2 wherein:

said first end of each said bristle comprises a bristle base adjacent said bristle head, and each said bristle base extends from said head at an orientation which is approximately perpendicular to a tangent on a surface of said bristle head proximate said bristle base.

5. The implement of claim 4 wherein said bristle head is generally cylindrical in shape.

6. The implement of claim 5 wherein:

said bristle head second end includes an end surface having a portion which is generally perpendicular to said handle longitudinal axis, and wherein bristles extend from said bristle head second end.

7. The implement of claim 2 wherein:

said second ends of said bristles include flagged portions for enhancing particle entanglement.

8. The implement of claim 2 wherein:

said bristle head includes a plurality of bristle bores, wherein each said bristle bore is adapted to receive a plurality of bristles.

9. The implement of claim 2 wherein said radial compressing means further comprising:

a bristle cover including a first open end and an end wall on a second end thereof, said end wall having an opening in a center portion thereof for accepting said handle therethrough;

wherein said transversely extending bristles engage an inner surface of said cover to releasably retain said cover over said bristles; and wherein said bristles conform to an inside surface shape of said cover.

10. The implement of claim 9 further comprising:

an annular shoulder proximate said first bristle head end for engaging said cover end wall on an interior portion of said cover when said cover encloses said bristles, thereby preventing further movement of said cover over said bristle head and off of said implement.

11. The implement of claim 9 wherein said cover comprises a generally cylindrical wall, said first open end is generally circular in shape, and said end wall is generally annular in shape.

12. The implement of claim 9 further comprising:

a centering portion disposed on said handle for centering said cover on said bristles, wherein said centering portion is disposed on a portion of said handle and proximate to said bristle head, wherein said centering portion includes a larger diameter larger than all other portions of said handle; and wherein said centering portion allows less clearance between said opening in said end wall and said centering portion than between said opening in said end wall and all other portions of said handle.

13. The implement of claim 12 wherein:

a longitudinal length of said cover is configured to align and center said first open end of said cover with said first bristle head end when said opening in said end wall is axially aligned with said centering portion, for facilitating placement of said cover over said bristles.

14. The implement of claim 9 further comprising:

means for releasably retaining said cover on said handle after said cover has been axially moved on said handle to expose said bristles.

15. The implement of claim 2 further comprising:

a threaded receptacle disposed on said second end of said handle; and an elongated handle extension having a first threaded end and a second end, wherein said first threaded end of said extension is releasably received within said threaded receptacle to effectively lengthen said handle.

16. The implement of claim 15 wherein:

said elongated handle extension includes first and second concentrically arranged telescoping members for changing the length of said elongated handle extension.

17. An implement for removing undesirable particles from remote locations, comprising:

a handle having a longitudinal axis and first and second ends;

a bristle head disposed at said first handle end and having a generally cylindrical shape for receiving and supporting a plurality of bristles, wherein said bristle head includes a first end attached to said first handle end, and said bristle head terminating at a second end, said bristle head second end includes an end surface having a generally semi-spherical shape having a portion which is generally perpendicular to said handle longitudinal axis and wherein bristles extend from said bristle head second end as well as the cylindrical portion of the bristle head, wherein the bristles extending from the cylindrical portion of the bristle head extend from said bristle head;

means for radially compressing said bristles for shipping, storage and retail display; and wherein said bristles retain their original shape after prolonged radial compression.

18. The implement of claim 17 wherein:

at least some of said bristles are generally straight.

19. The implement of claim 17 wherein:

at least some of said bristles have a curved shape.

* * * * *